United States Patent [19]

Szczepanski

[11] 4,087,023

[45] May 2, 1978

[54] AIRSPACE TYPE SPRAY DISPENSER

[76] Inventor: Harry Szczepanski, 755 Oakleigh Rd., NW., Grand Rapids, Mich. 49504

[21] Appl. No.: 781,748

[22] Filed: Mar. 28, 1977

[51] Int. Cl.[2] ..... B67D 37/00

[52] U.S. Cl. ..... 222/209; 222/211; 222/212; 239/327

[58] Field of Search ..... 222/95, 209, 211, 212, 222/386.5, 389; 239/327; 222/214

[56] References Cited

U.S. PATENT DOCUMENTS

| | | | |
|---|---|---|---|
| 2,758,879 | 8/1956 | Anderson | 222/209 |
| 2,777,612 | 1/1957 | Bensen | 222/209 |
| 3,217,931 | 11/1965 | Farrar et al. | 239/327 X |
| 4,020,978 | 5/1977 | Szczepanski | 222/209 |

*Primary Examiner*—Allen N. Knowles
*Assistant Examiner*—David A. Scherbel
*Attorney, Agent, or Firm*—Glenn B. Morse

[57] ABSTRACT

A device for dispensing liquids in spray form has an outer resiliently deformable housing surrounding a more readily deformable inner container of liquid, with an airspace in between. Manual pressure on the housing generates pressure in the airspace, which compresses the container and causes it to discharge some of its contents. Part of the pressurized air is conducted to an orifice adjacent to the point of discharge of the liquid to assist in atomizing the discharge. Vent holes in the housing for return air into the airspace must be covered for generating the pressure, and these are spaced to minimize the danger of operation by children. The discharge nozzle assembly is constructed for simplicity of plastic molding, and for replaceable nozzle components to adapt the device for a variety of liquids. The assembly also provides for a substantial fill opening for the inner container, and adequate sealing after filling.

12 Claims, 17 Drawing Figures

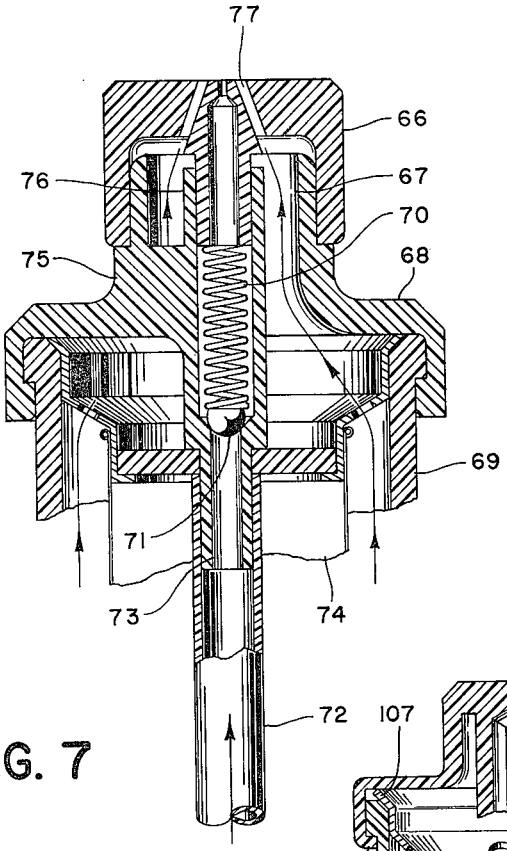
FIG. 7
FIG. 12
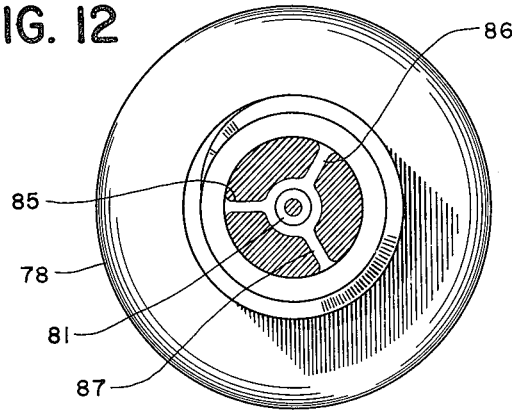
FIG. 11
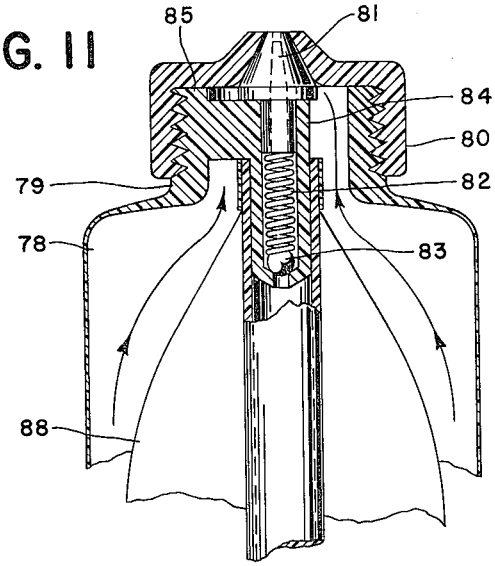
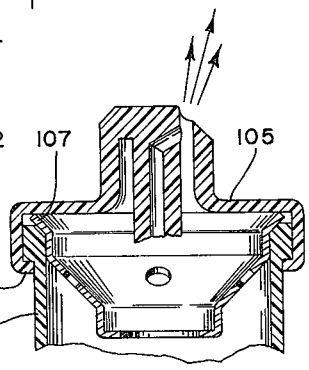
FIG. 9
FIG. 8
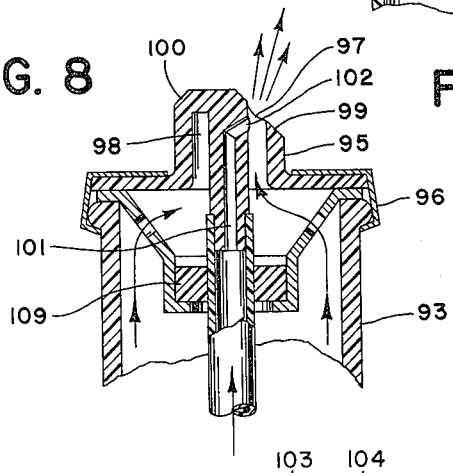
FIG. 13
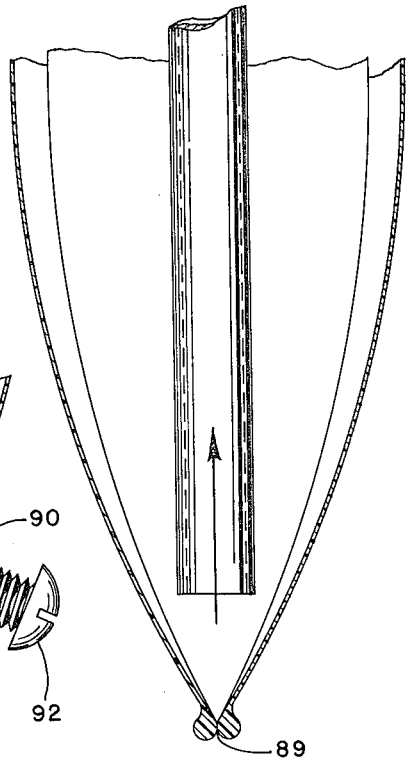
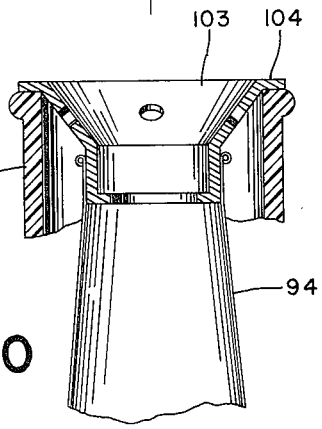
FIG. 10

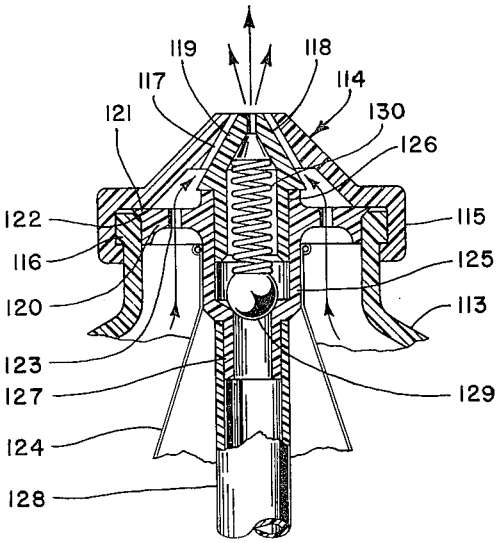
FIG. 14
FIG. 15
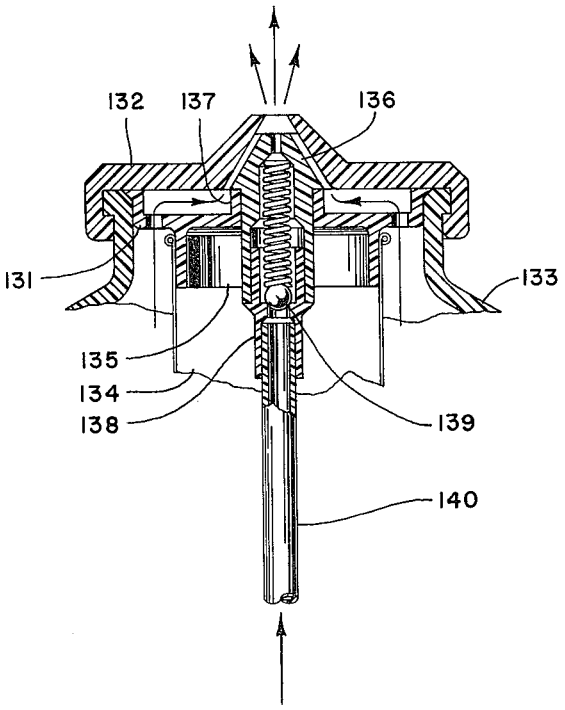
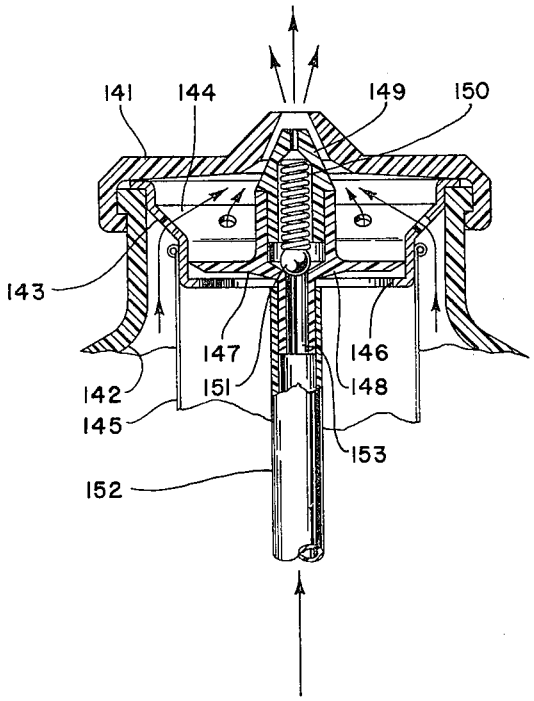
FIG. 16
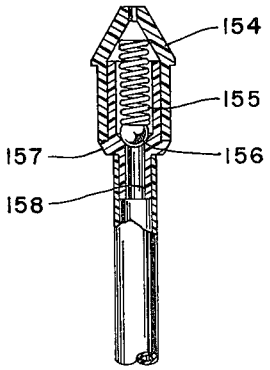
FIG. 17

AIRSPACE TYPE SPRAY DISPENSER

BACKGROUND OF THE INVENTION

The environmental pollution factor associated with freon-pressurized containers is resulting in a very active search for alternative arrangements. One of these is the well-known pump dispenser in which a piston is manually actuated to induce flow of the liquid up through a withdrawal tube in the container, and out through a nozzle orifice. Whatever atomizing affect of the spray emerging from the orifice is due entirely to the pressure as the liquid emerges, and is consequently limited by the available finger pressure at the actuator, and also by the pumping efficiency of the mechanism.

An alternative arrangement is described in my Application Ser. No. 605,185, filed in the United States Patent and Trademark Office on Aug. 15, 1975 now U.S. Pat. No. 4,020,978. In summary, the device disclosed in that application involves an outer housing that is easily deformable under manual pressures. This housing surrounds an inner and very readily deformable liquid container, with an airspace in between these components. Pressure on the outer housing deflects it inwardly, increasing the pressure in the airspace, and consequently applies this pressure to the inner container to squeeze some of its contents out through the discharge passage. The significant factor in this assembly is the utilization of the air pressure to additionally provide a high velocity jet adjacent the point of discharge of the liquid to increase the atomization effect. The present invention provides an improvement on this type of device, the primary objectives being an assembly which can be adapted readily to a variety of liquids, and in which the inner container is more easily filled through a substantial opening that is sealed effectively after the filling has been completed.

SUMMARY OF THE INVENTION

A resilient outer housing has an end-closure member providing a central tubular receptacle for receiving selected nozzle members. The receptacle also provides a tubular passage communicating from the bore of the nozzle member into the interior of a readily deformable inner container surrounded by an airspace between the inner container and the outer housing. The receptacle is supported by structure adapted to provide an air passage arranged to conduct air from the airspace to a point adjacent the nozzle orifice. In the preferred form of the invention, the inner container is suspended from a transverse member having an axially-extending surface defining a cross-sectional area of substantial size. The reception of the mouth of the inner container over this surface, and the provision of a large central opening in the transverse member, provides for ready filling of the inner container, followed by blocking this opening with a plate providing the necessary seal as the assembly is used after filling.

DESCRIPTION OF THE DRAWINGS

FIG. 7 is a partial sectional elevation showing a further modification of the invention.

FIG. 8 is a sectional elevation showing a further modification of the invention.

FIG. 9 is a view of the FIG. 8 assembly without the central sealing plate and withdrawal tube.

FIG. 10 is a sectional elevation showing the lower portion of the FIG. 8 assembly.

FIG. 11 is a sectional elevation of a further modification of the invention.

FIG. 12 is a top view of the FIG. 11 assembly, with the cap removed.

FIG. 13 is a fragmentary sectional elevation showing a modified construction at the lower extremity of an assembly similar to that shown in FIG. 11.

FIG. 14 is an axial section through the top assembly of a modified form of the invention.

FIG. 15 is an axial section through the top portion of a further modification of the invention.

FIG. 16 is an axial section through the top assembly of a further modification of the invention.

FIG. 17 is an axial section of a nozzle sub-assembly.

DESCRIPTION OF THE PREFERRED EMBODIMENTS

Figure 1:
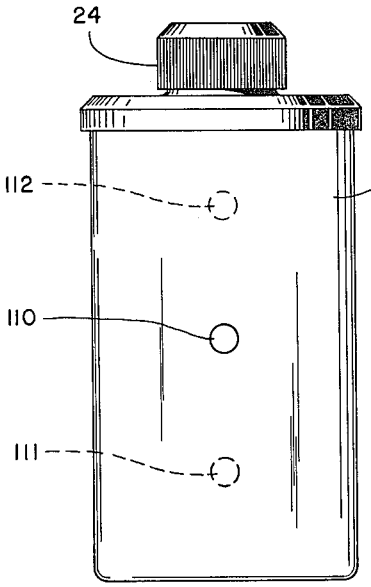
FIG. 1 is a side elevation of a device embodying the present invention.

Referring to the drawings, the dispenser shown in FIGS. 1 through 4 includes the outer deformable body portion of the housing 20, surrounding the inner, and much more flexible container 21, with an airspace indicated at 22 in between. An outer cap (not shown) can be slipped over the inner cap 24 to close off the discharge orifice 25 and the atomizing air passage 26, which would otherwise remain exposed during periods in which the device was not in use. The inner cap 24 is in threaded engagement with the annular extension 27 of the end-closure member 28 of the outer housing 20. The member 28 has a skirt section 29 having an inwardly-extending lower extremity providing a snap-in engagement with the outwardly extending ridge 30 of the housing 20.

The inner cap 24 has a central opening defined by the conical surface 31, which is geometrically similar to the conical outer surface 32 of the nozzle element 33. The axial adjustability of the cap 24 resulting from its threaded engagement with the member 28 provides for adjustment of the air passage 26, which is the space between the surfaces 31 and 32. The nozzle element 33 has a tubular extension 34 received within the tubular receptacle 35 integral with the member 28. The receptacle 35 has a tubular lower extension 36 continuing with a portion 37 of reduced diameter. This latter portion traverses a sealing plate 38, and extends through the opening 39 in the transverse member 40 positioned by having its peripheral flange 41 received between the member 28 and the top of the housing 20. The lower extremity of the reduced-diameter tubular portion 37 receives the liquid-withdrawal tube 42 through which the contents of the inner container 21 are delivered to the upper portion of the structure.

Figure 3:
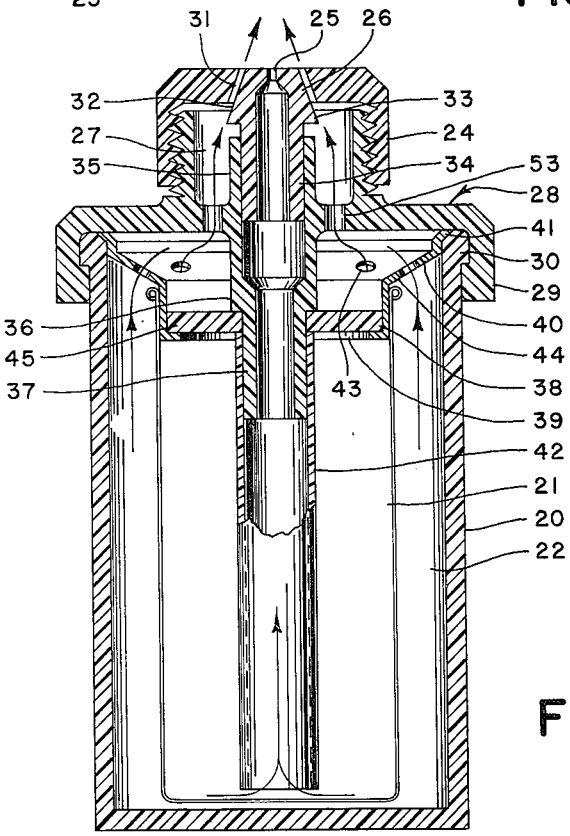
FIG. 3 is a sectional elevation through the preferred form of the invention, on an enlarged scale over FIGS. 1 and 2.

Perforations as indicated at 43 in FIG. 3 extend around a bevelled portion 44 connecting the flange 41 of the member 38 with an axially-extending surface 45 provided for closely receiving the upper end of the inner container 21. The filling of the device is thus simplified considerably, as this may be done prior to the assembly of the inner container 21 to the surface 45, or prior to the installation of the sealing plate 38. The securing of the upper end of the inner container to the surface 45 can either involve the use of adhesive, or a standard constricting ring.

Figure 6:
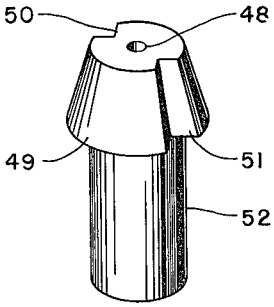
FIG. 6 is a perspective view on an enlarged scale showing a modified nozzle component.

It is usually desirable to provide at least some air passage at 26 as a minimum, without relying on the maintenance of close tolerances in the manufacture of the inner cap 24 and the portion 27 of the member 28. This can be done by providing flat areas as shown at 46 and 47 on the otherwise conical surface 32 of the nozzle unit. The portion 34 of the nozzle unit is preferably received in a press fit within the receptacle 35, with some degree of freedom of axial adjustability, as shown in FIG. 3. This arrangement provides an additional means for eliminating accumulations of tolerance, so that a proper relationship can be maintained between the conical surfaces 31 and 32. In FIG. 6, a modified form of nozzle unit is illustrated in which the discharge orifice 48 corresponds to the orifice 25 in FIG. 3, and the conical surface 49 to the surface 32. The flats 46 and 47, however, are replaced by the V-shaped grooves 50 and 51 forming the same function of providing minimal air passages. The tubular extension 52 corresponds to the portion 34 in FIG. 3.

Figure 2:
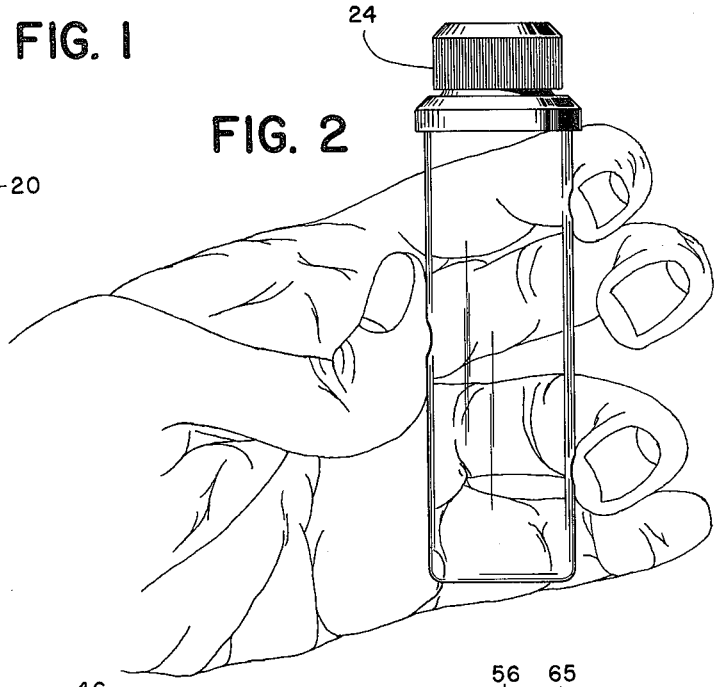
FIG. 2 is a view showing the operation of the dispenser by hand pressure.
Figure 4:
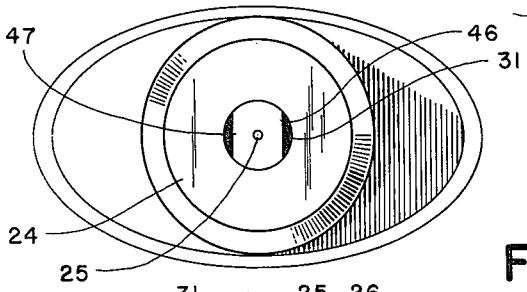
FIG. 4 is a top view of the FIG. 3 assembly.

Squeezing of the outer housing 20 as shown in FIG. 2 increases the air pressure in the space 22, constricting the inner container 21. This effect drives liquid up through the tube 42 through the tubular sections 37, 36, 35, 34, and out through the discharge orifice 25. This same increase air pressure in the space 22 is communicated through the perforations 43 and through the openings 53 in the member 28 to the air-discharge passage 26 to assist in the atomization of the liquid emerging at the orifice 25. Obviously, various types of liquid varying primarily in viscosity will require different openings at 25, and a different amount of air emerging at 26. This same assembly can accommodate such various liquids by providing a selection of nozzle elements having small differences in the diameter of the orifice 25, and these can be color-coded to permit the unit to proceed along an assembly line with a fair certainty of a proper matching of the completed device to the particular liquid within the inner container 21. Normally, the provision of a press fit between the sealing plate and the inside surface of the member 44 opposite the surface 45 will provide an adequate seal to any contained liquid material, on the assumption that the material of the plate 38 is properly chosen to avoid interaction with the liquid. The plate 38, is, of course, normally either press-fitted or adhesively sealed to the portion 37, along with the tube 42.

Figure 5:
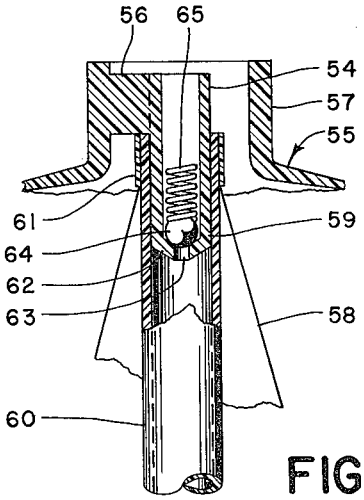
FIG. 5 is a fragmentary sectional elevation of a modified form of the invention.

Referring to FIG. 5, a modified form of the invention is shown in which the receptacle 54 is positioned within the top member 55 of a dispenser by angularly-spaced webs as shown at 56 extending generally radially between the cylindrical portion 57 and the receptacle. A bag-shaped inner container 58 is shown with a relatively smaller mouth than that in FIG. 3, which is slipped over the tubular lower extension 59 of the receptacle 54. The withdrawal tube 60 will normally be interposed between the inner container 58 and the portion 59, with the components held in assembled relationship either by a constricting ring 61, or by appropriate adhesives. FIG. 5 illustrates the simplicity with which a ball valve can be added to the FIG. 3 assembly simply by providing a transverse lower portion as shown at 62 having a central hole 63. This modification of the lower extension 37 provides a seat for the ball valve 64, which is preferably biased downward by a spring 65, which is simply dropped in ahead of the insertion of a nozzle element of the type shown in either FIG. 3 or in FIG. 6. The spring 65 is thus compressed between the ball 64 and the lower extremity of the nozzle element.

FIG. 7 illustrates the incorporation of the ball-valve into an assembly having components similar to that shown in FIG. 5. In the FIG. 7 arrangement, the cap 66 is merely slipped on to the tubular section 67 of the member 68, which engages the outer housing 69 in the same manner as described in connection with FIG. 3. The spring 70 bias the ball valve 71 to closed position, blocking off the passage which includes the tube 72 and the tubular receptacle extension 73. The inner container 74 corresponds to the container 21 of FIG. 3. The angularly spaced webs 75 support the receptacle 76, providing for the flow of air between the webs 75 to the air passage indicated at 77. The remainder of the assembly is similar to that shown in FIG. 3.

FIGS. 11 and 12 show a modified form of the invention that is particularly applicable to a more bag-shaped outer housing 78. This configuration can be die-extruded or molded in the manner of a tooth paste tube, with the thickened upper section 79 providing a portion for threaded interengagement with the cap 80. The nozzle element 81 confines the spring 82 acting on the ball valve 83 in the manner previously described, with the tubular receptacle 84 supported by the angularly spaced webs 85-87, as shown in FIG. 12. FIG. 12 illustrates the top view of the FIG. 11 assembly, with the cap 80 removed. The inner container 88 is secured in the same manner as that shown in FIG. 5. It is possible to close the lower end of both the inner container 88 and the outer housing 78 by heatsealing or crimping both of these containers together at 89. The FIG. 11 assembly is thus filled from the lower end, with the upper extremity preferably fully installed, followed by closing the device at 89. FIG. 13 illustrates a modification at the lower extremity that can be provided where it is desirable to refill the FIG. 11 assembly. The grommet 90 provides a passage 91 traversing the walls of both the inner container and the outer housing, which can be sealed by the screw 92. Refill can be made at this point.

FIGS. 8, 9, and 10 illustrate further modifications of the invention. The upper portion of the assembly can generate a spray that is angled away from the axis of the outer housing 93. FIG. 8 shows the assembly without the inner container 94, and FIG. 10 illustrates the assembly prior to the addition of a top component 95 held in place by the closure ring 96. The air-discharge opening 97 is actually the intersection of the annular space 98 with the inclined surface 99 on the upper projection 100 of the member 95. The transverse upper extremity of the passage 101, shown at 102, should be directly opposite the opening 97 in order that the portion 102 can be either cored or drilled in proper position without disturbing the remainder of the member 95. The perforate transverse member 103 has its peripheral flange 104 received between the top edge of the housing 93 and the member 95, and either held there by the ring 96, or by the modified top member 105 shown in FIG. 9 having its own retaining flange 106 crimped or snapped into position on assembly. The flange 104 can be disposed in a plane perpendicular to the axis of the device, as shown in FIG. 10, or as shown at 107 in FIG. 9, in which it is in a bevelled configuration interengaged with a similarly-bevelled surface on the inside of the container 108. With the dimensional proportions shown in FIG. 8, the transverse sealing plate 109 can be conveniently in the form of a highly resilient material such as rubber, with the components simply pressed into the illustrated relationship. The perforated plate 103 is similar in function to the plate 44 of FIG. 3.

In all of the above modifications, it is possible to incorporate a feature that minimizes the danger of operation of the dispenser by children. The holes 110-112 in the housing shown in FIG. 1 must be covered by the fingers and thumb of the user as shown in FIG. 2 for air pressure to develop in the airspace 22. This requires careful placement of the hand, which eliminates the accidental or random squeezing characteristic of a small curious child.

Referring to FIG. 14, the opening defining the upper end of the outer housing 113 is covered by the cap 114 provided with the peripheral flange 115 adapted for snap-in interengagement with the outwardly-projecting rim 116 of the housing. The central conical aperture 117 normally remains in spaced relationship with the conical exterior surface 118 of the nozzle element 119, as previously described. The transverse plate 120 has a generally radially extending flange 121 tapering outwardly to reduced thickness, and interposed between the flared surface 122 at the mouth of the housing 113 and the cap 114. A group of perforations as indicated at 123 is spaced around the axis of the plate 120, and provides for the passage of air from the airspace between the housing 113 and the inner container 124. The receptacle 125 is integral with the plate 120, and receives the tubular section 126 of the nozzle element, and provides a lower tubular extension 127 for receiving the withdrawal tube 128.

The inner container 124 is secured to the outer surface of the receptacle portion 125, either through adhesive, or by the application of a standard retaining ring. The ball-valve 129 is biased to the closed position by the compression spring 130. Prior to the assembly of the ball-valve, spring, and the nozzle element to the plate 120, and preferably after these components have been assembled to the housing 113, the contents of the inner container 124 may be injected through the receptacle 125. This is preferably preceded by applying a slight vacuum to remove the air from the inner container 124. After the injection of the contents, the ball-valve, spring, and nozzle element can be inserted in the relationship shown in FIG. 14, followed by snapping the cover 114 into the illustrated position.

FIG. 15 shows an assembly similar in function to that illustrated in FIG. 14. The transverse perforated plate 131, however, is recessed so that the top 132 can be axially shorter, while still providing the necessary air passage leading from the space between the outer housing 133 and the inner container 134. The axially-extending collar 135 receives the mouth of the inner container 134 at a considerably larger diameter than that characteristic of the FIG. 14 assembly. The nozzle element 136 is received in an opening defined by the central collar 137 in the plate 131, and receives a lower section 138 forming a tubular extension establishing the seat for the ball-valve 139, and a coupling for the withdrawal tube 140. The characteristic of this assembly is that, in the absence of the top 132, the withdrawal of the nozzle element carries with it the tube 140 and the ball-valve assembly. Normally the section 138 will be either adhesively secured to the nozzle element, or will be press-fitted into the illustrated assembled relationship. In the absence of the nozzle element, the inner container 134 can be filled through the central opening in the plate 131.

Referring to FIG. 16, the cap 141 closes off the mouth of the outer housing 142 in the same manner characteristic of the FIGS. 14 and 15 assemblies. The transverse member 143 has its rim interposed between the cap and the mouth of the housing, and has the perforate flared portion 144 permitting passage of air from the space between the housing and the inner container 145. The opening defined by the inwardly-turned flange 146 of the member 143 is sealed by the radial flange 147 of the receptacle member 148. This latter member provides a central opening for receiving the nozzle element 149, the valve spring 150, and the ball-valve 151. The withdrawal tube 152 slips over the lower tubular extension 153 of the receptacle member 148. In the absence of the cap 141 and the assembly associated with the member 148, the entire opening 146 is exposed for the filling procedure. The periphery of the flange 147 should have a resilient press fit with the radially-opposite portion of the member 143 which receives the inner container 145.

The arrangements shown in FIGS. 14, 15, and 16, present a variety of possibilities for assembling standardized components in various ways to accommodate the particular needs of the contained liquid and the configuration of an outer housing. The nozzle assembly shown in FIG. 17 presents an alternate form to that appearing in FIG. 15, providing a more compact unit adaptable to assemblies where the axial space is limited. The nozzle element 154, the spring 155, the ball-valve 156, and the valve seat member 157 with its tubular extension 158 perform the functions previously described.

I claim:

1. A spray dispenser for liquid materials, said dispenser including a resiliently deformable outer housing, a deformable inner container disposed in said outer container to define an airspace between said containers, nozzle means mounted in said outer container and communicating with said inner container, and means forming an air passage communicating with said airspace and having an outlet adjacent said nozzle means, wherein the improvement comprises:

means forming a tubular receptacle normally fixed with respect to said outer container, portions of said air passage being disposed around said receptacle;

a nozzle element having a portion thereof received in said receptacle, said element having a central bore and a peripheral surface adjacent an end constituting the outlet of said nozzle means; and a cap normally engaging said outer container and having an opening normally surrounding said peripheral surface and normally in spaced relationship therewith.

2. A dispenser as defined in claim 1, wherein said nozzle element peripheral surface is substantially conical.

3. A dispenser as defined in claim 2, wherein said nozzle element conical surface is provided with at least one discontinuity forming a continuation of said air passage.

4. A dispenser as defined in claim 2, wherein said cap opening is defined by an interior conical surface geometrically similar to said nozzle element conical surface.

5. A dispenser as defined in claim 1, wherein said receptacle has an inner portion continuing axially inward from said nozzle element, and further including a tube engaging said inner portion and extending into said inner container.

6. A dispenser as defined in claim 1, wherein said tubular receptacle has a ball-valve disposed therein, and compression spring means interposed between said ball-valve and said nozzle element.

7. A dispenser as defined in claim 1, wherein said inner container is mounted on a transverse perforate member having the peripheral portion thereof interposed between axially interengaged components of said outer container.

8. A dispenser as defined in claim 7, wherein said transverse member has a central opening and an axially-extending surface surrounding said opening, and additionally including a closure plate normally occupying said opening, said tubular receptacle having a portion traversing said plate, a mouth portion of said inner container being received on said axially-extending surface.

9. A dispenser as defined in claim 1, wherein said tubular receptacle has a coupling portion axially extending inward from said nozzle element, said inner container having a mouth portion received over said coupling portion.

10. A dispenser as defined in claim 1, wherein said receptacle is integral with a transverse member having the peripheral edge thereof normally interposed between an edge of the body portion of said housing defining an end opening therein and said cap, and said nozzle element has a tubular portion normally fixed with respect thereto and traversing said transverse member, and further including a withdrawal tube normally secured to said tubular portion.

11. A dispenser as defined in claim 10, wherein said nozzle element and withdrawal tube are together insertable in said receptacle.

12. A dispenser as defined in claim 1, wherein said tubular receptacle has an internal valve seat, and said dispenser further includes a valve member and a valve spring interposed between said valve seat and said nozzle member.

* * * * *